US005701742A

United States Patent [19]

Eckels et al.

[11] Patent Number: 5,701,742

[45] Date of Patent: Dec. 30, 1997

[54] CONFIGURED INDIUM GASKET FOR THERMAL JOINT IN CRYOCOOLER

[75] Inventors: Phillip William Eckels; Daniel C. Woods, both of Florence, S.C.

[73] Assignee: General Electric Company, Milwaukee, Wis.

[21] Appl. No.: 581,099

[22] Filed: Dec. 29, 1995

[51] Int. Cl.[6] ..... F25B 9/00

[52] U.S. Cl. ..... 62/6; 62/51.1; 277/211

[58] Field of Search ..... 62/6, 51.1, 55.5; 277/211, 213, 215, 236

[56] References Cited

U.S. PATENT DOCUMENTS 5,247,800 9/1993 Mruzek et al. ..... 62/51.1

5,509,243 4/1996 Bettigole et al. ..... 52/334

*Primary Examiner*—Henry A. Bennett

*Assistant Examiner*—Pamela A. O'Connor

*Attorney, Agent, or Firm*—Dennis M. Flaherty; John H. Pilarski

[57] ABSTRACT

An indium gasket having a configuration which allows the indium to reach its yield point at a relatively low contact pressure. The indium gasket is provided with a multiplicity of openings which are filled by the deforming indium during compression between the cryocooler and the cryocooler interface sleeve of a superconducting magnet system. The creation of openings in the gasket has the effect of decreasing the mechanical interface pressure at which the indium yields. The indium flows at a mechanical interface pressure that does not exceed the structural strength requirements of the cryocooler. The indium flows into the empty spaces formed by the openings, thereby providing the necessary thermal conductance between the cryocooler and the interface sleeve. The result is a relatively small temperature difference between the interface sleeve and the cryocooler during cooling of the superconducting magnets.

20 Claims, 3 Drawing Sheets

CONFIGURED INDIUM GASKET FOR THERMAL JOINT IN CRYOCOOLER

FIELD OF THE INVENTION

This invention relates to a direct-contact thermal interface for demountably coupling a cryocooler to a magnetic resonance imaging system. In particular, the invention relates to gaskets used in demountable cryocooler cold heads for cooling radiation shields used in superconducting magnets.

BACKGROUND OF THE INVENTION

As is well known, a coiled magnet, if wound with wire possessing certain characteristics, can be made superconducting by placing it in an extremely cold environment, such as by enclosing it in a cryostat or pressure vessel containing liquid helium or other cryogen. The extreme cold reduces the resistance in the magnet coils to negligible levels, such that when a power source is initially connected to the coil (for a period, for example, of 10 minutes) to introduce a current flow through the coils, the current will continue to flow through the coils due to the negligible resistance even after power is removed, thereby maintaining a magnetic field. Superconducting magnets find wide application, for example, in the field of magnetic resonance imaging (hereinafter "MRI").

Cryocoolers using the Gifford-McMahon cycle, for example, can achieve low temperatures at their heat stations for removing heat from the interior of superconducting magnets. FIG. 1 is a schematic of a Gifford-McMahon refrigerator system 10, which generally comprises a compressor 12, a cylinder 14 closed at both ends, a displacer 16 slidably housed within the cylinder 14, a regenerator 18 and a heat exchanger 20. The displacer is mounted on the end of a rod 15 which is raised and lowered by a motor (not shown). The seals 22 form the boundary between an upper expansion space 24 and a lower expansion space 26 between the displacer and the cylinder. The upper expansion space 24 is in fluid communication with a junction 28, which in turn is in fluid communication with a junction 30. The outlet of compressor 12 is in fluid communication with junction 30 via a surge volume 32 and an inlet valve 34 connected in series. The inlet of compressor 12 is in fluid communication with junction 30 via an exhaust valve 36 and a surge volume 38 connected in series. The junction 30 is also in fluid communication with one side of regenerator 18. The other side of regenerator 18 is in fluid communication with a junction 40, as is the lower expansion space 26 and the outlet of the heat exchanger 20. The inlet of heat exchanger 20 is also in fluid communication with the lower expansion space 26. The sequence of operation for a Gifford-McMahon refrigerator is as follows:

With the displacer 16 at its lowermost position in the cylinder 14, the inlet valve 34 is opened and the compressor 12 is activated to increase the pressure inside the upper expansion space 24. While the inlet valve 34 is open and the exhaust valve 36 is closed, the displacer 16 is moved to its uppermost position within the cylinder 14. This forces gas from the upper expansion space 24 through the regenerator 18 to the lower expansion space 26. The gas is cooled as it passes through the regenerator 18. With the displacer 16 at its uppermost position, the inlet valve 34 is closed and the exhaust valve 36 is opened, which allows the gas in the lower expansion space 26 to expand. The gas remaining in the lower expansion space 26 is reduced to a low temperature. This low-temperature gas is then forced out of the lower expansion space 26 by moving the displacer 16 to its lowermost position. This cold gas flows through the heat exchanger 20, in which heat is transferred to the gas from a low-temperature source, and then into the regenerator 18, which warms the gas to near ambient temperature.

The foregoing description relates to a one-stage cryocooler, but the foregoing fundamental principle of operation is likewise application to multi-stage cryocoolers of the Gifford-McMahon variety, such as the two-stage cryocoolers commonly used in superconducting magnet systems for MRI. In particular, a two-stage cryocooler is incorporated in a known superconducting magnet system comprising: a circular cylindrical magnet cartridge having a plurality (e.g., three) of pairs of superconducting coils; a leaktight toroidal vessel which surrounds the magnet cartridge and is filled with liquid helium for cooling the magnets (the "helium vessel"); a toroidal low-temperature thermal radiation shield which surrounds the helium vessel; a toroidal high-temperature thermal radiation shield which surrounds the low-temperature thermal radiation shield; and a toroidal vessel which surrounds the low-temperature thermal radiation shield and is evacuated (the "vacuum vessel"). In superconducting magnet systems of this type, the two-stage cryocooler is thermally coupled to the high- and low-temperature thermal radiation shields. To connect the cryocooler heat stations to surfaces, such as radiation shields in an MRI system, from which heat is to be removed, high contact forces are needed as well as soft metal interfaces in order to achieve low thermal resistances.

At cryogenic temperatures, indium is used as an interface gasket for thermal joints. In a typical superconducting magnet design, indium is often used as the thermal interface gaskets 42 and 44 between the first and second stages of a two-stage cryocooler 46 and the cryocooler interface sleeve 48 (see FIG. 2). In order to obtain maximum thermal conductance, the interface pressure on the indium gaskets 42 and 44 must be such that the indium will reach its yield/flow point. At cryogenic temperatures, the yield/flow point is significantly higher (by a factor of 4) than at room temperature. However, there is a limit on the amount of contact pressure that can be applied to the indium in that there are limits on the structural strength of the cryocooler. If too much pressure is applied to the indium gasket, then the cryocooler could be structurally damaged.

A typical solid indium gasket configuration for the thermal joint between the second stage of a two-stage cryocooler and a cryocooler interface sleeve is shown in FIG. 3. The conventional indium gasket 44 comprises a circular plate 50 and four radially outwardly projecting tabs **52*a*–52*d* which are distributed around the circumference of the circular plate 50 at equiangular intervals. The indium gasket 44 is typically affixed to the end of the cylinder 14 (see FIG. 1) by folding the tabs 52*a*–52*d* up and around a flange 54 at the bottom of cylinder 14, as shown in FIG. 4, and then taping the ends of tabs 52*a*–52*d* against the outer circumferential surface of cylinder 14. The tape 56** is preferably wrapped around the entire circumference of the cylinder with the tab ends interposed therebetween.

The contact pressure needed to make this solid indium gasket yield and plastically deform could exceed the structural strength of the cryocooler. If the indium does not yield, then the thermal resistance will be too high, thereby limiting the cooling capacity of the cryocooler and causing a relatively high temperature difference between the cryocooler 46 and the cryocooler interface sleeve 48. Thus, there is a need to determine an indium gasket configuration which will allow the indium to yield and flow at a lower interface pressure that does not exceed the structural strength of the cryocooler, while still providing the necessary thermal conductance at the interface joint.

SUMMARY OF THE INVENTION

The present invention is an improved indium gasket having a configuration such that the indium is able to reach its yield/flow point at a contact pressure which is lower than the contact pressure needed to cause yielding and flowing of the conventional indium gasket. The improved indium gasket is provided with a multiplicity of openings which are filled by the deforming and flowing indium during compression between the cryocooler and its interface sleeve. The creation of openings in the gasket has the effect of decreasing the mechanical interface pressure at which the indium yields and flows. In accordance with the present invention, the indium flows at a mechanical interface pressure that does not exceed the structural strength requirements of the cryocooler. The indium flows into the empty spaces formed by the openings and melds to close those openings, thereafter providing the necessary contact area and thermal conductance between the cryocooler and its interface sleeve. The result is a relatively small temperature difference between the interface sleeve and the cryocooler during cooling of the superconducting magnets.

DETAILED DESCRIPTION OF THE PREFERRED EMBODIMENTS

The preferred embodiment of the invention will be described with reference to a two-stage cryocooler. However, it is understood that the invention has equal application in a cryocooler having one or more stages.

Figure 1:
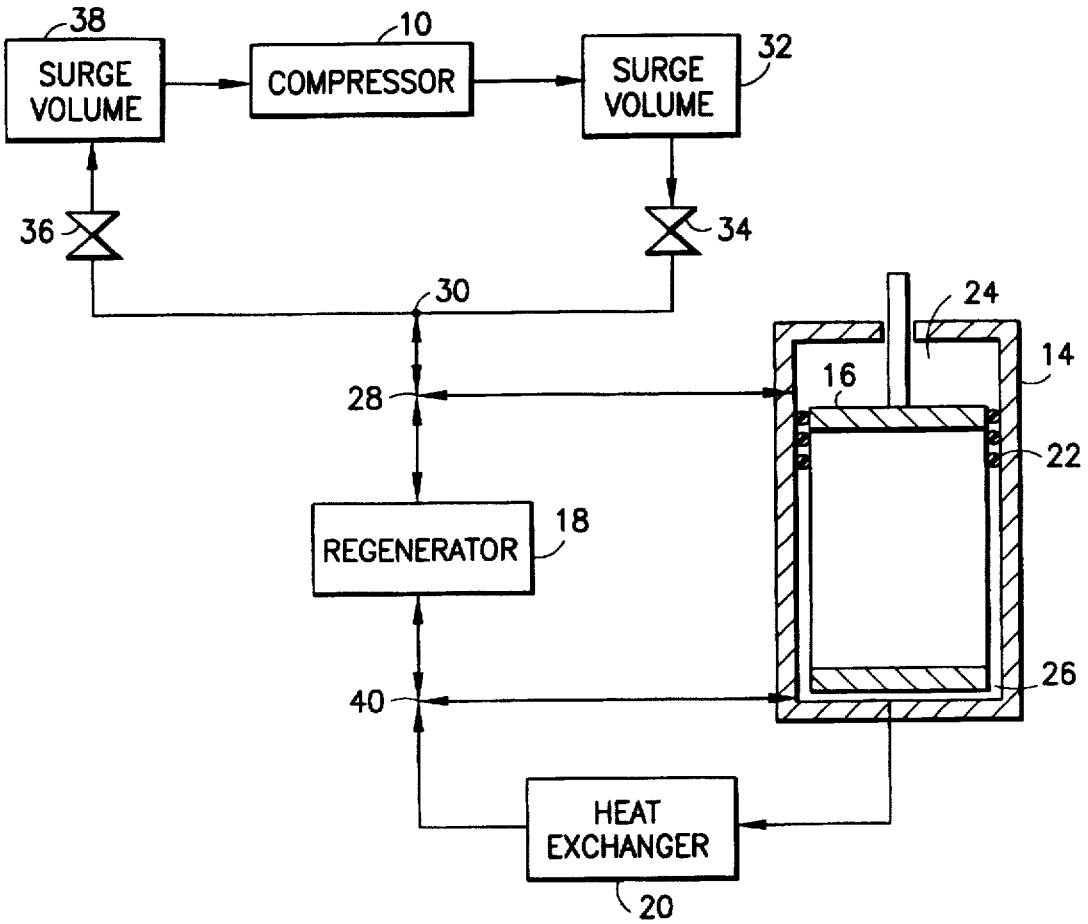
FIG. 1 PRIOR ART
FIG. 1 is a block diagram showing the basic components of a single-stage Gifford-McMahon refrigerator in accordance with prior art teachings.
Figure 2:
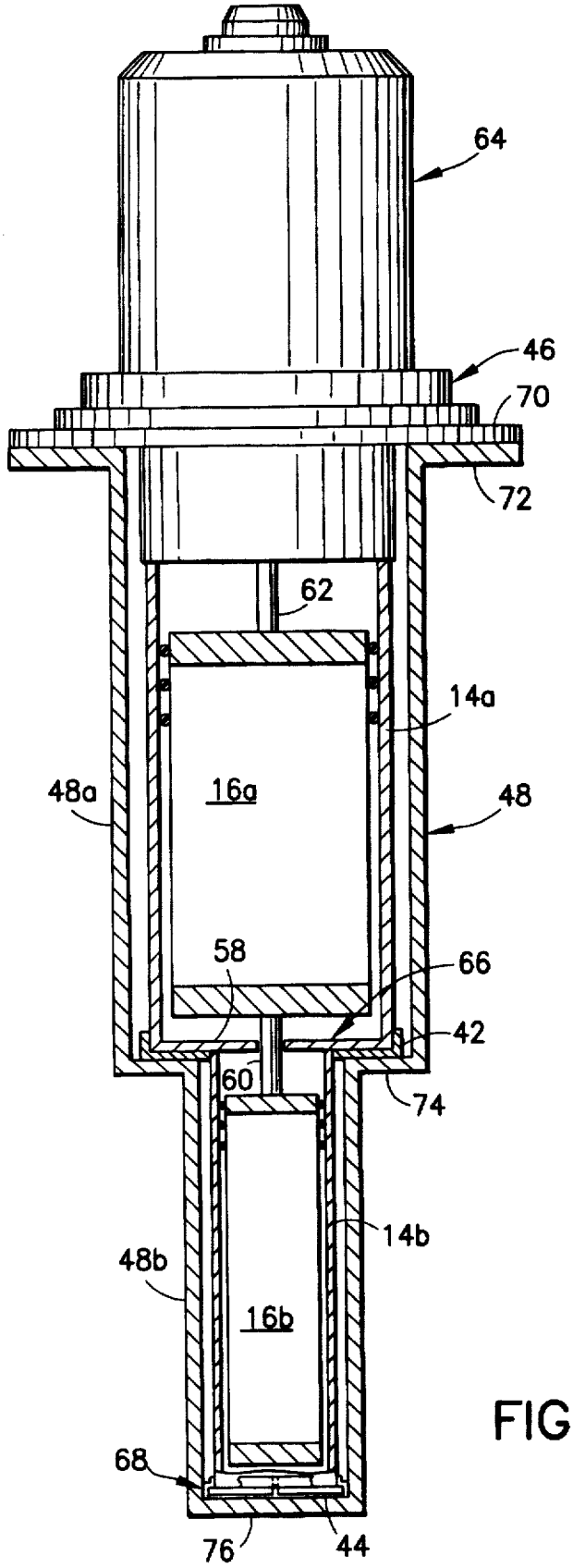
FIG. 2 is a schematic showing a partially sectional view of a two-stage cryocooler incorporating indium gaskets as thermal interfaces.

A two-stage cryocooler of the Gifford-McMahon variety suitable for cooling superconducting magnets is shown in FIG. 2. The two-stage cryocooler 46 comprises a pair of cylinders 14*a* and 14*b* arranged end to end in coaxial relationship. The upper cylinder 14*a* has a diameter greater than that of the lower cylinder 14*b*. The internal volumes of the cylinders are separated by an annular partition 58. The cylinder 14*a* houses a displacer 16*a*; cylinder 14*b* houses a displacer 16*b*. The displacers 16*a* and 16*b* are rigidly connected by a connecting rod 60 and vertically slidable inside the cylinders. Displacer 16*a* is connected to a drive rod 62 which displaces in response to actuation of a motor 64. During displacement of drive rod 62, the cylinders 14*a* and 14*b* travel in tandem.

In a two-stage cryocooler for cooling superconducting magnets, the heat stations are located at the end of the first and second stages of the cold head portion of the cryocooler. More specifically, the first heat station is the annular flange 66 which connects the bottom periphery of upper cylinder 14*a* to the upper periphery of lower cylinder 14*b*; and the second heat station is the circular end flange 68 at the bottom of the lower cylinder 14*b*.

The cryocooler 46 is installed in and attached to the cryocooler interface sleeve 48 by fastening a flange 70 of the cryocooler to a flange 72 of the interface sleeve. The cryocooler interface sleeve 48 further comprises an upper circular cylindrical sleeve section 48*a* having a diameter greater than the diameter of upper cylinder 14*a* and a lower circular cylindrical sleeve section 48*b* having a diameter greater than the diameter of lower cylinder 14*b*. The bottom periphery of upper sleeve section 48*a* is connected to the upper periphery of lower sleeve section 48*b* by means of an annular interface flange 74, which is thermally coupled to the high-temperature thermal radiation shield (not shown) by conventional heat piping means (not shown). The bottom of lower sleeve section 48*b* is closed by a circular interface end flange 76, which is thermally coupled to the low-temperature thermal radiation shield (not shown) by conventional heat piping means (not shown).

As seen in FIG. 2, the circular cylindrical walls of cylinders 14*a* and 14*b* are separated from the surrounding circular cylindrical walls 48*a* and 48*b* of the interface sleeve by a vacuum gap. In contrast, the first heat station 66 is thermally coupled to the interface flange 74 by means of an indium gasket 42. Similarly, the second heat station 68 is thermally coupled to the interface end flange 76 at the bottom of the interface sleeve by means of an indium gasket 44.

Figure 3:
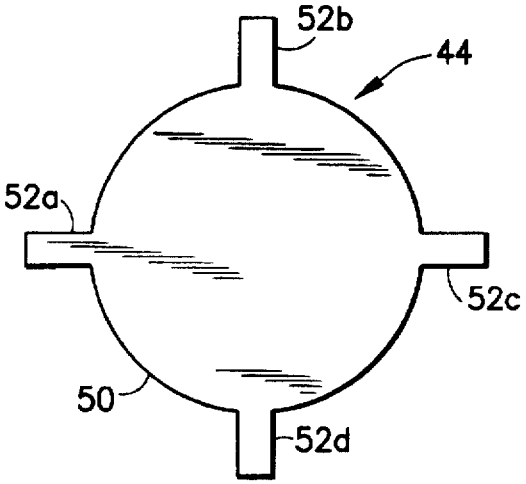
FIG. 3 PRIOR ART
FIG. 3 is a schematic showing a plan view of a conventional indium gasket incorporated in a cryocooler for superconducting magnets.
Figure 4:
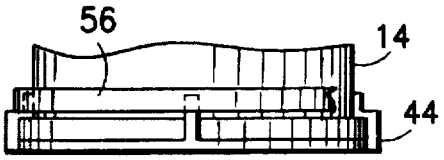
FIG. 4 PRIOR ART
FIG. 4 is a schematic showing a side view of a conventional indium gasket affixed to the end of a cryocooler cylinder in conventional fashion.
Figure 5A:
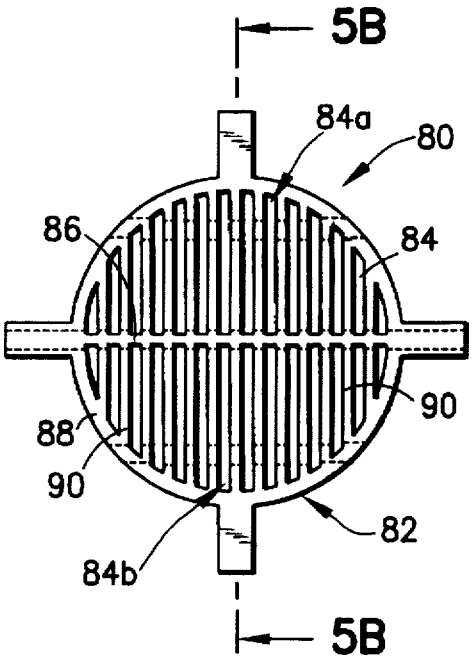
FIG. 5A is a schematic showing a plan view of an indium gasket in accordance with the preferred embodiment of the invention.
Figure 5B:
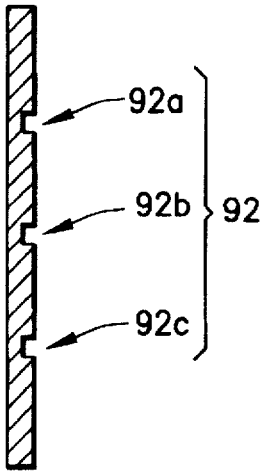
FIG. 5B is a schematic showing a sectional view of the indium gasket shown in FIG. 5A, the section being taken along line 5B—5B in FIG. 5A.

In accordance with the present invention, the indium gaskets are configured such that the indium is able to reach its yield/flow point at a contact pressure which is lower than the contact pressure needed to cause yielding of the conventional indium gasket depicted in FIG. 3. A preferred embodiment of such a configured indium gasket 80 is shown in FIGS. 5A and 5B. It differs from the prior art configuration shown in FIG. 3 in two respects. First, the circular plate 82 of indium gasket 80 has an open area consisting of a multiplicity of openings or penetrations in the thickness direction. Second, the gasket has grooves on one side for allowing gas contaminants to flow out of the empty spaces during gasket compression.

The openings in the thickness direction may take the form of two arrays of parallel slots 84 extending in opposite directions away from a spine 86 and toward the gasket periphery. In this configuration, the body of the gasket includes a circular ring 88, spine 86 extending along a diameter of ring 88 and two sets of parallel beams 90 connecting the circular ring to the diametral spine 86. The slots 84 are thus divided into two groups: slots 84*a* disposed on one side of spine 86 and slots 84*b* disposed on the other side of spine 86. In an exemplary construction, the width of each slot is equal to the width of each web 90 (e.g., 62 mils). The thickness of the gasket is generally in the range of 0.1–0.3 inch. The slots and channels may be hot pressed into the indium during its manufacture. Alternatively, the entire gasket can be cast with slots and channels incorporated therein.

The indium gasket depicted in FIG. 5A is suited for insertion between the second heat station 68 of the cryocooler 46 and the bottom end flange 76 of the cryocooler interface sleeve 48 in place of the conventional gasket 42. However, it is understood that an annular indium gasket, suitable for insertion between the first heat station 66 of the cryocooler 46 and the annular interface flange 74 of the cryocooler interface sleeve 48, can also be provided with openings which extend between an inner circular ring and an outer circular ring. The empty spaces 84 in improved gasket 80 allow the indium to reach its yield/flow point at a mechanical pressure significantly less than the pressure needed for the solid gasket 42 (shown in FIG. 3) to yield and flow. At the lower pressure, the structural strength of the cryocooler interface sleeve 48 is not exceeded. Also, after the yield point of the indium is exceeded, it flows (diameter reduction) into the empty spaces 84 (see FIG. 5A), thus providing the necessary contact area and thermal conductance between the cryocooler 46 and cryocooler interface sleeve 48.

As shown in FIG. 5B, the gasket 80 in accordance with the preferred embodiment of the invention also has a plurality of channels 92 formed in the undeformed gasket. The channels 92 run parallel to the surface on one side of the gasket. These channels 92 allow gas contaminants that are trapped as frost in the empty spaces 84 of the gasket 80 to escape into the vacuum space of the cryocooler interface sleeve 48 during deformation of the gasket.

In accordance with the preferred embodiment shown in FIGS. 5A and 5B, three channels **92*a*, 92*b* and 92*c* are formed parallel to the gasket surface on one side of the gasket. The channels 92*a*–92*c* run parallel to each other and perpendicular to slots 84. Each of channels 92*a* and 92*c* comprises a series of aligned grooves formed in adjacent beams 90 and in the circular ring 88. Thus, channel 92*a* allows gas to flow between adjacent slots in group 84*a*, while channel 92*c* allows gas to flow between adjacent slots in group 84*b* during gasket deformation under compression. Channel 92*b*, on the other hand, runs along the bottom of spine 86 and has a width greater than the width of the spine. Channel 92*b* has a length equal to the length of spine 86. Thus, channel 92*b* allows gas to flow from the slots of one group to the slots of the other group during gasket deformation under compression. Optionally, channel 92*b*** can be extended into the adjacent tabs.

The solid gasket shown in FIG. 3 was tested and did not yield at the maximum mechanical interface pressure that would not exceed the structural strength of the cryocooler. The thermal conductance was also relatively low in that the temperature difference between the cryocooler interface sleeve 48 and the cryocooler 46 was 1.0° K.

The configured indium gasket shown in FIGS. 5A and 5B was then installed and yielded better results. The indium flowed at a mechanical interface pressure that did not exceed the structural strength requirements of the cryocooler and the temperature difference between the interface sleeve and the cryocooler was approximately 0.1° K.

The preferred embodiment of the invention has been disclosed for the purpose of illustration. Variations and modifications which do not depart from the broad concept of the invention will be readily apparent to those skilled in the design of actively shielded superconducting magnets. For example, the set of suitable gasket configurations is not limited to the precise geometry shown in FIG. 5A. It will be readily apparent to persons skilled in the design of indium gaskets that deviations from the geometry of FIG. 5A can be readily conceived without departing from the spirit and scope of the claimed invention. All such variations and modifications are intended to be encompassed by the claims set forth hereinafter.

We claim:

1. A thermal interface gasket comprising a generally planar substrate made of an integral mass of mechanically deformable, heat conducting material having a top surface and a bottom surface, wherein said substrate is penetrated by a plurality of openings, each opening extending from said top surface to said bottom surface.

2. The thermal interface gasket as defined in claim 1, wherein said material is indium.

3. The thermal interface gasket as defined in claim 1, wherein said plurality of openings comprises an array of parallel slots.

4. The thermal interface gasket as defined in claim 1, wherein said substrate comprises a circular ring, a spine extending along a diameter of said circular ring and a plurality of parallel beams connecting said spine to said circular ring.

5. The thermal interface gasket as defined in claim 4, wherein said substrate has a plurality of grooves which allow fluid communication between said openings during gasket compression.

6. The thermal interface gasket as defined in claim 4, wherein said spine has a thickness less than a thickness of said circular ring.

7. The thermal interface gasket as defined in claim 4, wherein said substrate further comprises a plurality of tabs projecting radially outward from said circular ring.

8. The thermal interface gasket as defined in claim 1, wherein said plurality of openings are arranged such that said openings become closed by deforming material in response to application of a force sufficient to cause said material to yield.

9. A method for forming a thermal joint between opposing surfaces of first and second components of a superconducting magnet system, comprising the steps of:

fabricating mechanically deformable, heat conducting material into a gasket penetrated by a plurality of openings;

placing said gasket in contact with one of the opposing surfaces; and pressing the opposing surfaces together with sufficient force to cause said material to yield and flow, wherein said openings are arranged and configured such that said openings become closed as said material flows and melds in response to said pressing step.

10. The method as defined in claim 9, wherein said material is indium.

11. A thermal interface gasket comprising a generally planar grid structure made of a mechanically deformable, heat conducting material, said grid structure of said gasket comprising a plurality of beams.

12. The thermal interface gasket as defined in claim 11, wherein said beams of said plurality are mutually parallel.

13. The thermal interface gasket as defined in claim 12, wherein a configuration of said plurality of beams is such that openings between said beams are closed by deforming material during application of a force, in a direction perpendicular to a plane of said grid structure, sufficient to cause said material to yield.

14. A thermal interface gasket comprising a generally planar grid structure made of mechanically deformable, heat conducting material, said grid structure comprising a plurality of mutually parallel beams, wherein said generally planar grid structure of said gasket further comprises a circular ring, an end of each of said beams being joined to said circular ring.

15. The thermal interface gasket as defined in claim 14, wherein said generally planar grid structure further comprises a spine disposed perpendicular to said beams, another end of each of said beams being joined to said spine.

16. The thermal interface gasket as defined in claim 13, wherein said generally planar grid structure further comprises a plurality of tabs projecting radially outward from said circular ring.

17. The thermal interface gasket as defined in claim 15, wherein said spine has a thickness less than a thickness of said circular ring.

18. The thermal interface gasket as defined in claim 14, wherein each of said beams has a groove formed on one side thereof, said groove extending transverse to a longitudinal axis of said beam.

19. A thermal interface gasket made of mechanically deformable, heat conducting material and having a configuration such that in an undeformed state said gasket is penetrated in a thickness direction by a plurality of openings and in a deformed state said openings are closed, said gasket undergoing a change of state from said undeformed state to said deformed state in response to application of a force, in a direction perpendicular to a plane of said gasket, sufficient to cause said material to yield and flow.

20. The thermal interface gasket as defined in claim 19, comprising a plurality of members separated by empty spaces in said undeformed state.

* * * * *